US010179397B1

(12) United States Patent
Hunter

(10) Patent No.: US 10,179,397 B1
(45) **Date of Patent: *Jan. 15, 2019**

(54) VALVE SEAT PULLER

(71) Applicant: Jacob Hunter, Elk City, OK (US)

(72) Inventor: Jacob Hunter, Elk City, OK (US)

( * ) Notice: Subject to any disclaimer, the term of this patent is extended or adjusted under 35 U.S.C. 154(b) by 77 days.

This patent is subject to a terminal disclaimer.

(21) Appl. No.: 15/163,155

(22) Filed: May 24, 2016

Related U.S. Application Data

(63) Continuation-in-part of application No. 14/267,035, filed on May 1, 2014, now Pat. No. 9,579,779.

(60) Provisional application No. 62/168,413, filed on May 29, 2015, provisional application No. 61/854,852, filed on May 2, 2013.

(51) Int. Cl.
*B25B 27/02* (2006.01)
*F04B 53/10* (2006.01)

(52) U.S. Cl.
CPC ..... *B25B 27/02* (2013.01); *F04B 53/1087* (2013.01)

(58) Field of Classification Search
None
See application file for complete search history.

(56) References Cited

U.S. PATENT DOCUMENTS

| | | | | |
|---|---|---|---|---|
| 1,958,330 | A * | 5/1934 | Beard | B25D 1/16 279/106 |
| 3,611,540 | A | 10/1971 | Gibu | |
| 3,990,139 | A | 11/1976 | Touchet | |
| 4,507,837 | A | 4/1985 | Hinkle | |
| 4,724,608 | A | 2/1988 | Parrott | |
| 5,276,951 | A | 1/1994 | Gluszek | |
| 6,712,574 | B1 * | 3/2004 | Roopnarine | F16B 37/0857 411/267 |
| 2015/0283689 | A1 * | 10/2015 | Weaver | B25B 27/062 29/890.121 |

* cited by examiner

*Primary Examiner* — Joseph J Hail
*Assistant Examiner* — Brian D Keller
(74) *Attorney, Agent, or Firm* — Phillips Murrah PC; Martin G. Ozinga

(57) ABSTRACT

The present invention provides an apparatus, system and method for replacing seats utilizing J-shaped hooks on a puller shaft that may be compressed to pass through the seat and expand back to engage the seat from below for pulling upward and removal.

1 Claim, 19 Drawing Sheets

VALVE SEAT PULLER

CROSS-REFERENCE TO RELATED APPLICATIONS

The present application is a continuation-in-part of U.S. patent application Ser. No. 14/267,035, filed on May 1, 2014, currently pending, which claims priority from U.S. Provisional Patent Application Ser. No. 61/854,852, filed on May 2, 2013. The present application also claims priority from U.S. Provisional Patent Application Ser. No. 62/168,413 filed on May 29, 2015. Each of the applications listed above is hereby expressly incorporated herein by reference in their entirety.

BACKGROUND OF THE INVENTION

1. Field of the Invention

In general, the present invention relates to an apparatus and system for removing seats. More particularly, the present invention provides an improved puller that utilizes spring loaded J-shaped hooks for removing various seats, valve seats, pump liners and so forth from oilfield fracturing pumps, mud pumps, nitrogen pumps, and other equipment found in the oil and gas industry as well as other equipment utilizing same. It is also understood the current invention may be utilized in any other pump type that utilizes replaceable open face seats.

2. Description of the Prior Art

Due to the nature of seats in general, it is often extremely difficult to remove the seat after it is installed. There are many prior art devices for pulling pump valve seats and liners, but most of them are complex and expensive. If a valve seat puller is complex, it consumes time in the removal of the valve seat, which translates into money lost during the down time. It is not unusual for the down time in removing a valve seat with prior art devices to run 8-20 hours.

It is understood that in various piston type reciprocating pumps there are valves, which open and close in order to direct the flow. The valve mates to a replaceable seat in order to create a seal stopping the fluid, which is being pumped, moving in the direction it is being forced. Over time with the opening and closing of the valves against seat creates wear causing the valves not to seal. The common term used for worn seats is "washed". At this time, the seats must be replaced with new ones.

Valve seats in most pumps are generally slightly tapered, with or without an O-ring, for sealing the seat to the pump head. They are typically held in place by the taper, in that they are pressed into place. When a seat is replaced, it is removed with a puller. There are several different types of pullers used, which include a two half puller that spreads out to the inside dimension of the seat by threading the puller shaft inside it, opening the two outer halves far enough to catch the bottom of the seat. This is typically done by two people where one lowers the puller shaft down through the seat, while another person reaches the two half parts of the puller through an open port in the head. The person with the threaded shaft then attempts to thread the puller shaft into the expandable halves. A hydraulic jack, such as a hollow shaft jack, is then generally utilized to pull the shaft.

Another commonly used puller is a flat plate that hinges on the bottom of the puller body. It is tipped vertically and then inserted through the seat where gravity causes the flat plate to fall horizontally, thus catching the bottom of the seat and pulled with the same hydraulic jack. These types of pullers fail regularly in that they will not withstand very high pulling pressures. The normal practice at this point, when the pullers have failed, is to call a welder to cut the seat out of the pump with an acetylene torch. This naturally exposes the head of the pump to be "nicked" or cut into with the torch that can cause the head to have to be removed and taken to be repaired.

Another example of a prior art valve seat puller is U.S. Pat. No. 3,990,139 issued to Touchet on Nov. 9, 1976. This device utilizes J-shaped hooks wherein the hooks are essentially individual pieces that work in cooperation and are hinged at the top portion to allow the hooks to spread out and engage the valve seat when in position. These J-shaped hooks are not spring loaded; therefore, require a mechanical means to spread the hooks out to engage the seat. More specifically and quoting the issued patent, one embodiment of the pipe pulling apparatus 10 comprises a plurality of J-shaped hooks 24 having a J-shaped end or head 26 and a transverse T-shaped other end 25. The hooks 24 are pivotally supported by its T-shaped end 25 in radial slots 33 of support block or plate 22. In another embodiment, the J-shaped hooks are supported in slots 61 in support block 54 by a transverse T-shaped head portion 57, with the opposite end having a J-shaped head 59 for engaging the lower rim of valve seat 52 when pivoting.

This prior art device has several inherent problems due to the configuration of the individual J-shaped hooks and need for the hooks to pivot by a mechanical means. Needless to say, any obstruction in the pivot movement would prevent the J-shaped hook from rotating out for extending and thus would not allow for the hook to catch the valve seat. Dirt and debris in the field associated with the use of pumps is more common than not and frequently inhibited the hook from pivoting as needed. Also of note, rust would frequently inhibit the pivot movement requiring cleaning and lubricating of the part to keep it from binding.

Furthermore, sometimes the hook would be stuck in the extended position because the pivot problem. This would mean that the J-shaped hook would not pass through the valve seat opening and often would cause further damage when hitting the valve seat. It is not uncommon for the stuck out J-shaped hook to further push down the seat, damage, it and so forth making it even more difficult to remove.

Still furthermore, the prior art device of U.S. Pat. No. 3,990,139 essentially utilizes a threaded shaft to spread the J-shaped hooks as well as to extract the seat once engaged by use of rotational force for lifting. Current valve seats are typically seated in a tighter fashion making the torque required to rotational lift extremely high which leads to failures, stripping of threads, and damage to motors needed to provide the rotational movement.

It is, therefore, desirable to provide a valve seat puller and or extractor that provide a spring function to spread the j-shaped hooks to engage the seat when desired and eliminate the need for a mechanical system to engage the hooks. It is also desirable to provide a puller that may be utilized with a hydraulic jack to pull the seat up and out without the need for rotational lifting.

Present day drilling operations are extremely expensive, and an effort to increase the overall efficiency of the drilling operation while minimizing expense requires the essentially continuous operation of the drilling rig. Thus, it is imperative that downtime be minimized. The above discussed limitations in the prior art is not exhaustive. Thus, there is a need for an apparatus, method and system to remove valve seats, pump liners, and so forth easily and quickly. The current invention provides an inexpensive, time saving, more reliable apparatus and system where the prior art fails.

SUMMARY OF THE INVENTION

In view of the foregoing disadvantages inherent in the known types of pullers now present in the prior art, the present invention provides a new and improved apparatus and system, which is easier to utilize and more time efficient. As such, the general purpose of the present invention, which will be described subsequently in greater detail, is to provide a new and improved seat puller apparatus and system for replacing seats, which has all the advantages of the prior art devices and none or fewer of the disadvantages.

To attain this, the present invention essentially comprises a new and improved assembly that utilizes spring loaded J-shaped hook made from a metal that provides sufficient strength for forces required to pull out the seat, pump liner and so forth, flexible enough to bend as needed to enter the seat, and yet still rigid enough to return to its natural state for repeated use. The invention may be utilized for removing various seats, valve seats, pump liners and so forth from oilfield fracturing pumps, mud pumps, nitrogen pumps, and other equipment found in oil and gas industry as well as other equipment utilizing same. It is also understood the current invention may be utilized in any other pump type that utilizes replaceable open face seats.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved apparatus, system and method for removing and or pulling seats, pump liners, and so forth, which may be easily and efficiently utilized.

It is a further object of the present invention to provide a new and improved apparatus, system and method for removing seats, pump liners, and so forth, which is of a durable and reliable construction and may be utilized with multiple types of applications in the oil and gas field as well as other applications.

An even further object of the present invention is to provide a new and improved apparatus, system and method for removing seats, pump liners and so forth, which is generally susceptible to a low cost of manufacture with regard to both materials and labor, and which accordingly is then susceptible to low prices of sale to the consuming industry, thereby making such tool economically available to those in the field.

Still another object of the present invention is to provide a new and improved apparatus, system and method for removing seats, pump liners and so forth, which provides all of the advantages of the prior art, while simultaneously overcoming some of the disadvantages normally associated therewith.

Another object of the present invention is to provide a new and improved apparatus, system and method for removing seats, pump liners, and so forth that does not require a conventional spring assembly and has fewer moving parts than prior art devices.

Yet another object of the present invention is to provide a new and improved apparatus, system and method for removing seats, pump liners, and so forth that may allow for one individual to operate, may be operated with no one having to reach inside a pump head, and generally reduces the risk of injury.

Still another object of the present invention is to provide a new and improved apparatus, system and method for removing seats, pump liners, and so forth, which increases the speed of the replacement operation regarding changing out of associated parts.

An even further object of the present invention is to provide a new and improved apparatus, system and method for removing seats, pump liners, and so forth that provides a robust device capable of extreme and numerous uses and may generally withstand much greater amounts of pressure than existing pullers known in the art.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

FIG. 1 is generally a depiction of a preferred embodiment of the invention generally showing a partially exploded perspective view of spring catch 20, bottom nose 30, puller shaft 40, and sleeve 50 in accordance with the current invention.

FIG. 2 is generally a depiction of a preferred embodiment of the invention generally showing a cutaway side view as utilized in a pump and generally depicting spring catch 20 bottom 220 and or segment(s) 260 distal end(s) 270 passing through valve seat 90 after compression of spring catch 20 in accordance with the current invention.

FIG. 3 is generally a depiction of a preferred embodiment of the invention generally showing a perspective view of spring catch 20, bottom nose 30, puller shaft 40, and sleeve 50 wherein spring catch 20 is generally in an upward position sleeve 50 in accordance with the current invention.

FIG. 4 is generally a depiction of a preferred embodiment of the invention generally showing a perspective view of spring catch 20, bottom nose 30, puller shaft 40, and sleeve 50 wherein spring catch 20 is generally in a downward position relative to sleeve 50 and bottom 220 of spring catch 20 in communication with bottom nose 30 recessed lip portion 280 in accordance with the current invention.

FIG. 5A is generally a preferred embodiment of the invention depicting spring catch 20 in compression as it passes through valve seat 90 in accordance with the current invention.

FIG. 5B is generally a preferred embodiment of the invention depicting spring catch 20 after it has passed completely through valve seat 90 with spring catch 20 no longer in compression in accordance with the current invention.

FIG. 5C is generally a preferred embodiment of the invention depicting spring catch 20 after it has passed completely through valve seat 90 with spring catch 20 no longer in compression and in communication with valve seat 90 as hydraulic jack 200 is lifting to remove valve seat 90 in accordance with the current invention.

FIG. 5D is generally a preferred embodiment of the invention depicting spring catch 20 after it has passed completely through valve seat 90 with spring catch 20 no longer in compression and in communication with valve seat 90 after jack 200 has lifted and removed valve seat 90 in accordance with the current invention.

FIG. 6A is generally a depiction of a preferred embodiment of the invention generally showing a bottom view where in spring catch 20 is in compression and passing through valve seat 90 while bending into smaller circumference 165 in accordance with the current invention.

FIG. 6B is generally a depiction of a preferred embodiment of the invention generally showing a bottom view where spring catch 20 is no longer in compression and returned to original circumference 175 thus allowing J-shaped hooks 160 to engage lower rim 110 of valve seat 90 for pulling upward and out in accordance with the current invention.

FIG. 7 is generally a preferred embodiment of the invention depicting spring catch 20 after it has passed completely through valve seat 90 with spring catch 20 no longer in compression and in communication with valve seat 90 after jack 200 has lifted and removed valve seat 90 in accordance with the current invention. This depiction is essentially a larger image of FIG. 5D.

FIG. 8 is generally a preferred embodiment of the invention depicting spring catch 20 after it has passed completely through valve seat 90 with spring catch 20 no longer in compression in accordance with the current invention. This depiction is essentially a larger image of FIG. 5B.

FIG. 9 is generally a preferred embodiment of the invention depicting spring catch 20 after it has passed completely through valve seat 90 with spring catch 20 no longer in compression and in communication with valve seat 90 as jack 200 is lifting to remove valve seat 90 in accordance with the current invention. This depiction is essentially a larger image of FIG. 5C.

Figure 12A:
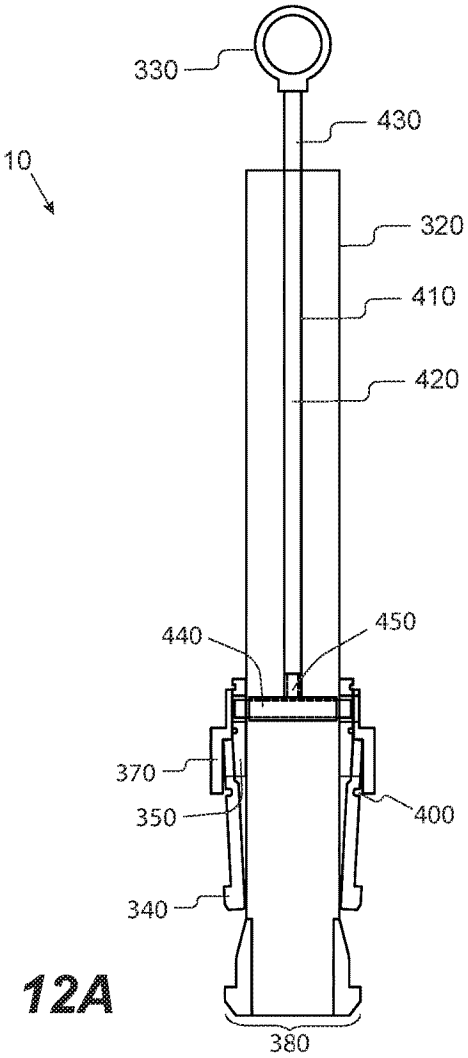
FIG. 12A is generally a depiction of a preferred embodiment of the invention in FIG. 10 generally showing a cutaway side view as utilized in a pump and generally depicting catch assembly 320 preparing to pass through valve seat 90 in accordance with the current invention.
Figure 12B:
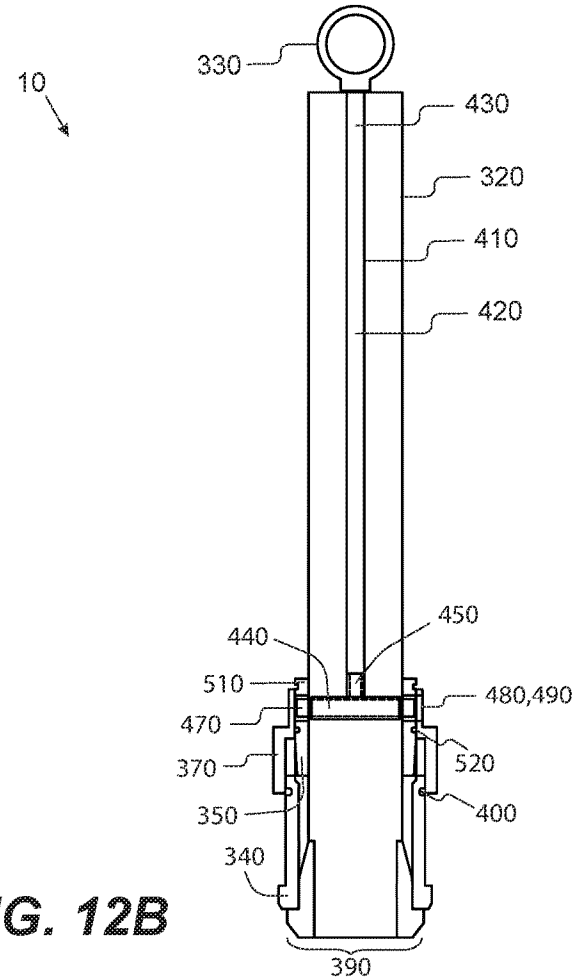
FIG. 12B is generally a depiction of a preferred embodiment of the invention in FIG. 10 generally showing a cutaway side view as utilized in a pump and generally depicting catch assembly 320 preparing to engage valve seat 90 for removal in accordance with the current invention.
Figure 13:
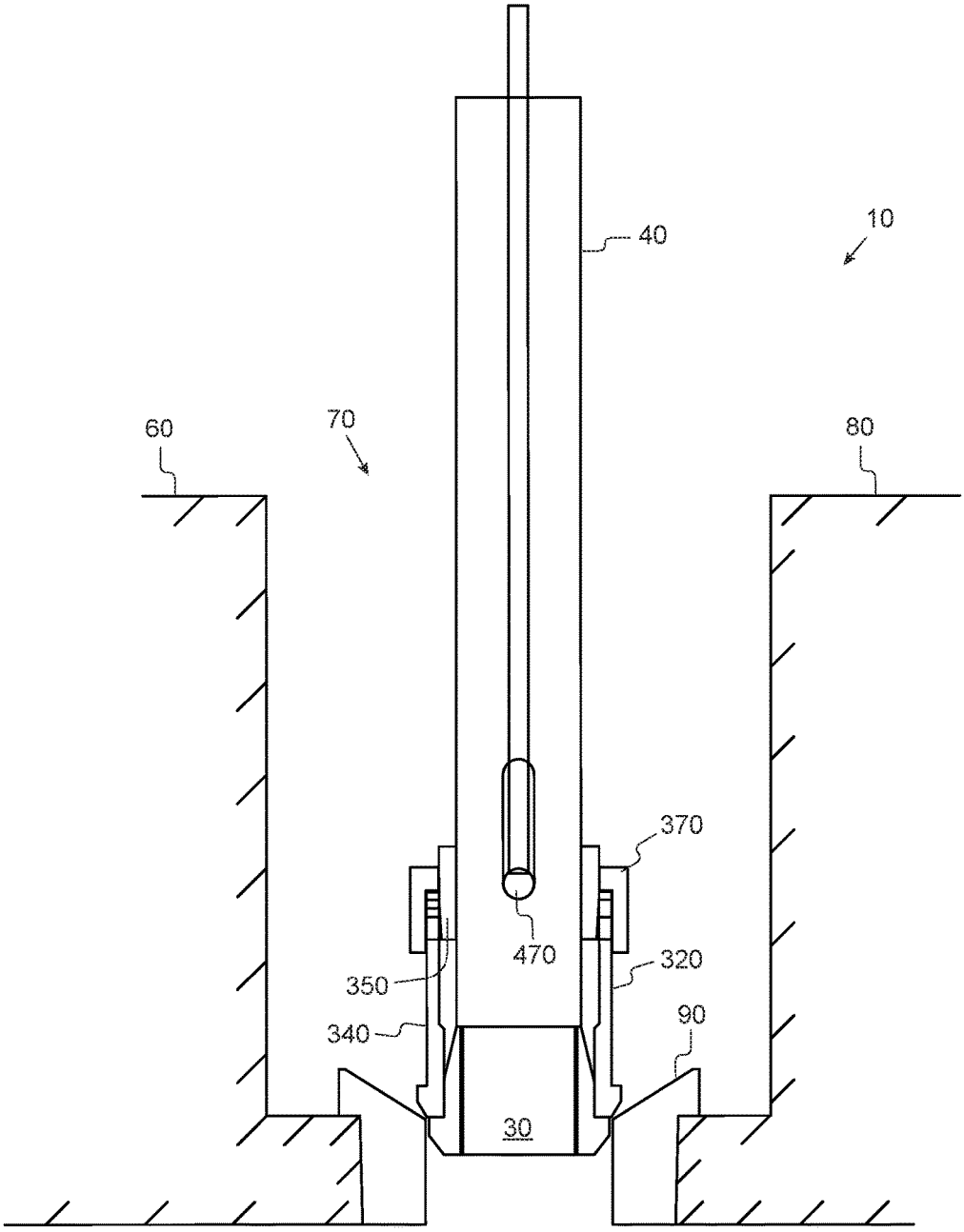

FIG. 13 is generally the depiction in FIG. 12B of invention 10 demonstrating that catch assembly 320 may not pass through valve seat 90 when in the second position 390 in accordance with the current invention.

Figure 14:
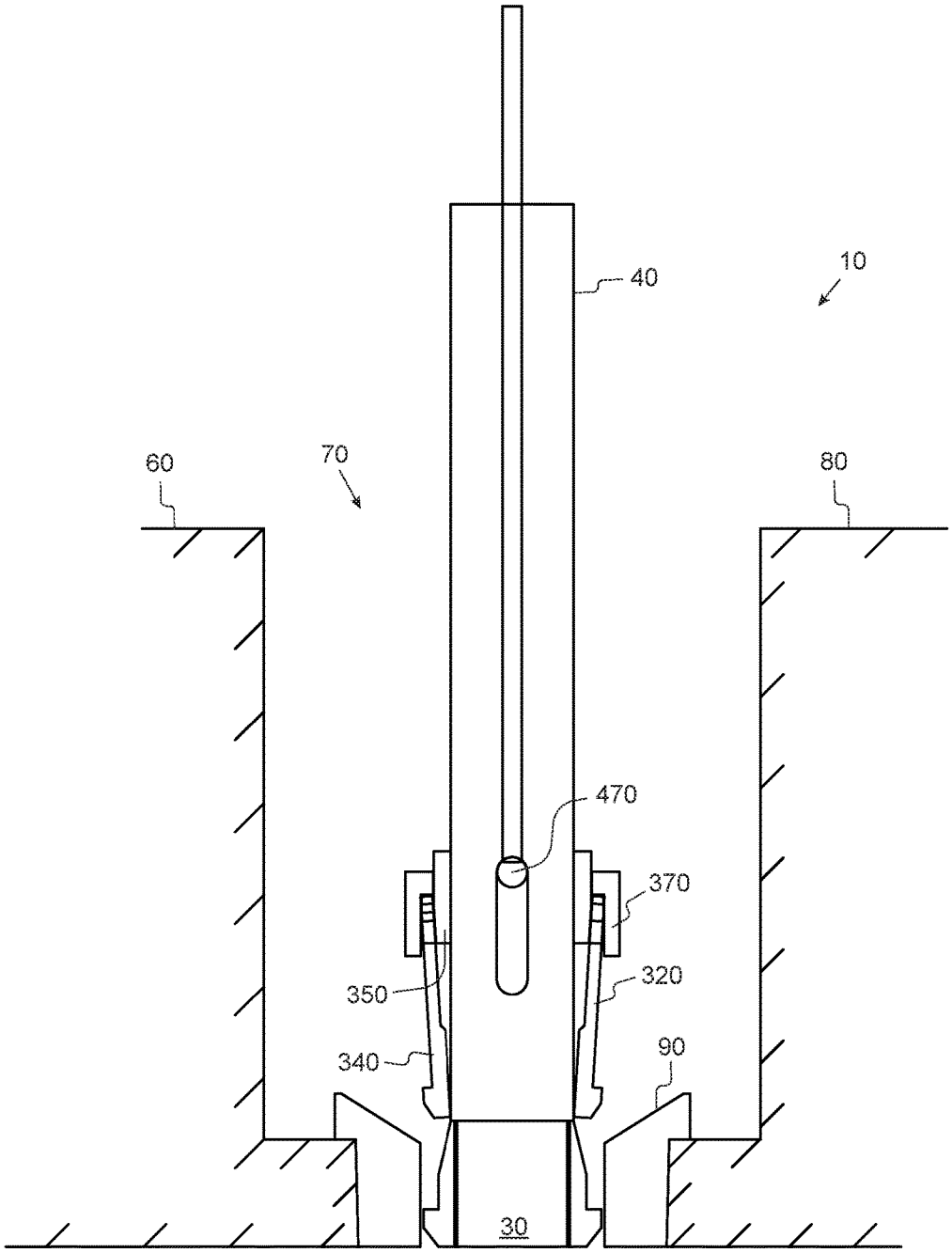

FIG. 14 is generally a preferred embodiment of the invention in FIG. 12A depicting catch assembly 320 in first position 380 preparing to pass through valve seat 90 in accordance with the current invention.

Figure 15:
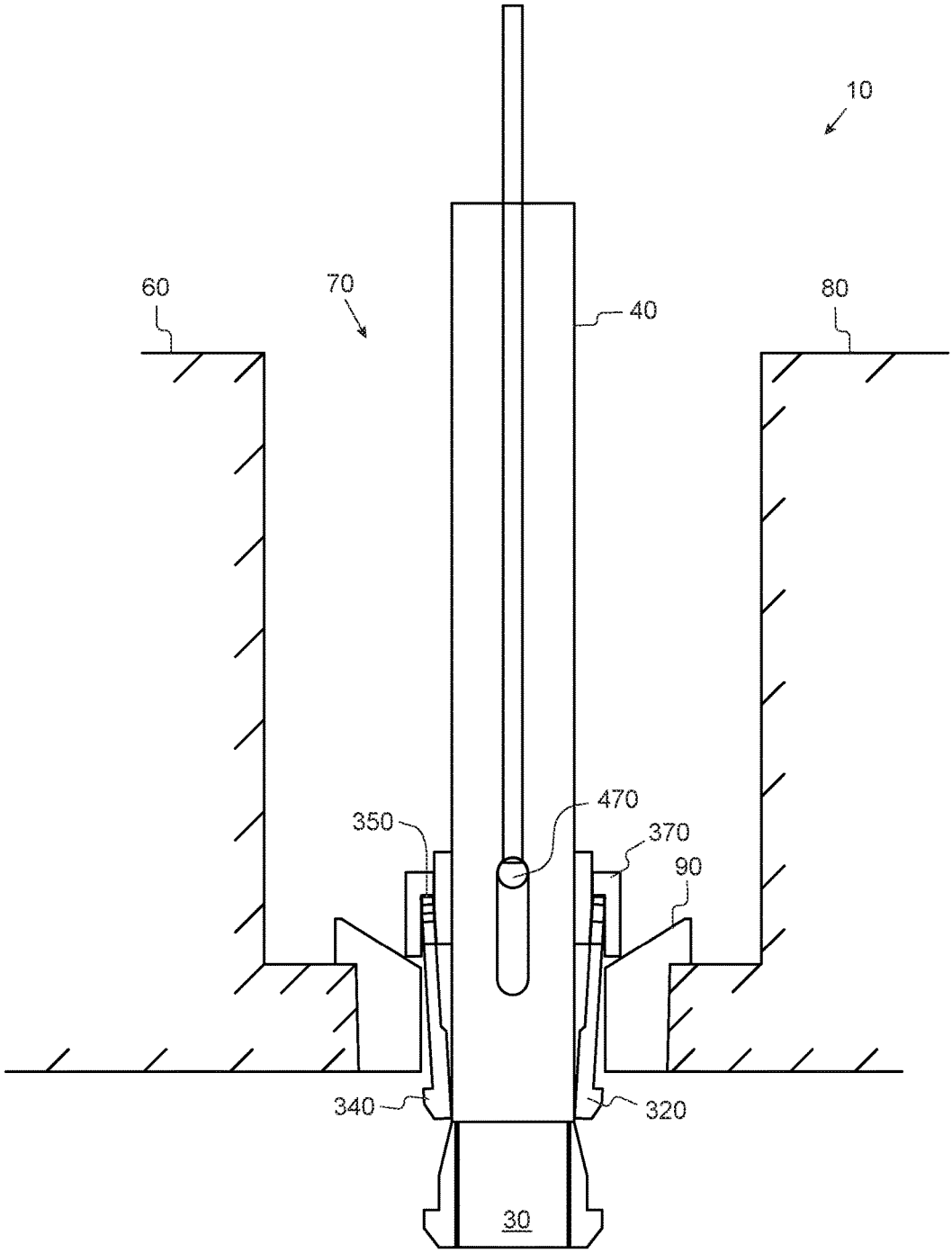

FIG. 15 is generally depicting catch assembly 320 in first position 380 preparing to pass through valve seat 90 wherein sleeve housing 370 has contacted valve seat 90, which may indicate it is time to utilize engagement mechanism 410 changing catch assembly 320 from first position 380 to second position 390 in accordance with the current invention.

Figure 16:
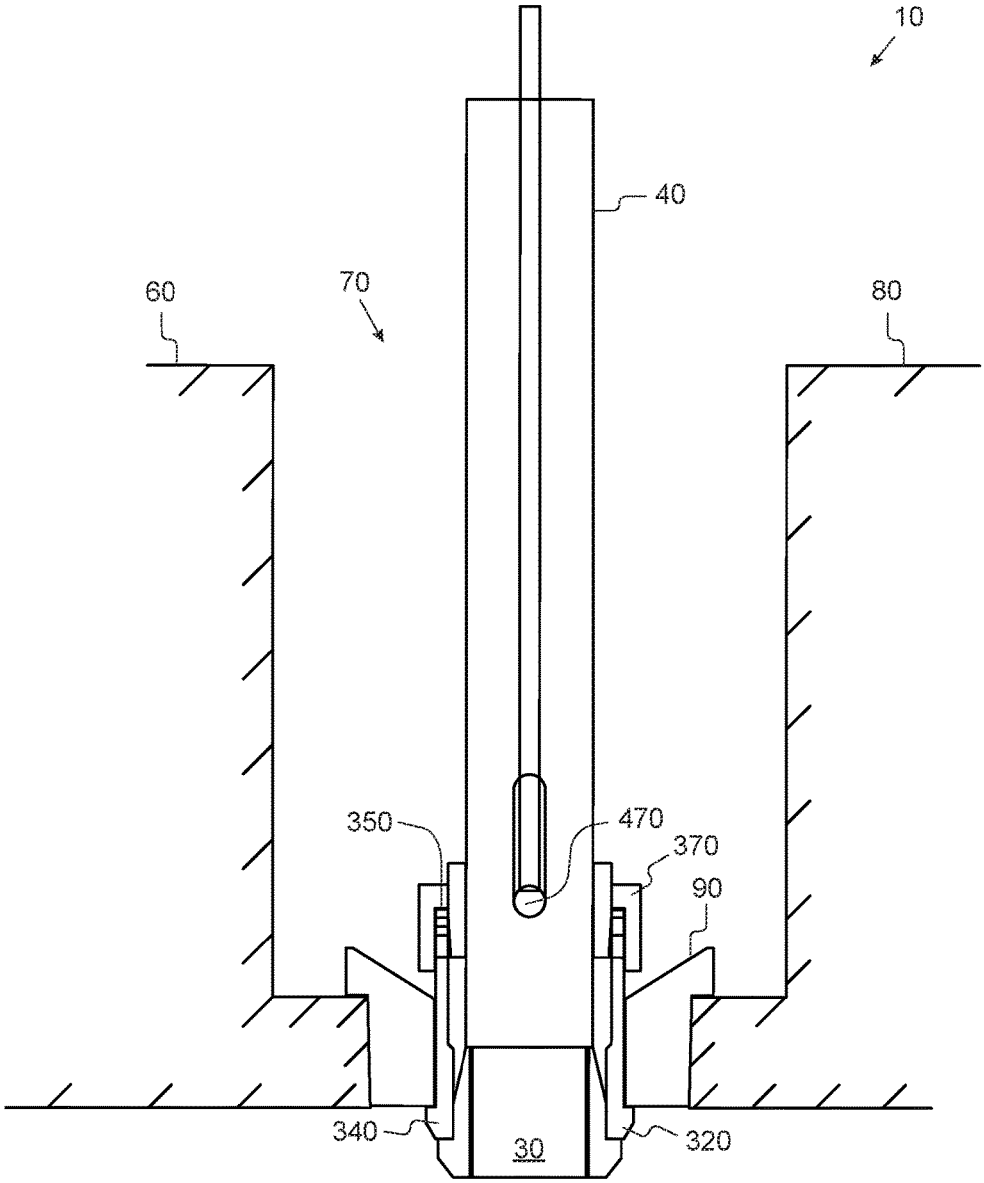

FIG. 16 is generally depicting catch assembly 320 in second position 390 engaging valve seat 90 for removal in accordance with the current invention.

Figure 17:
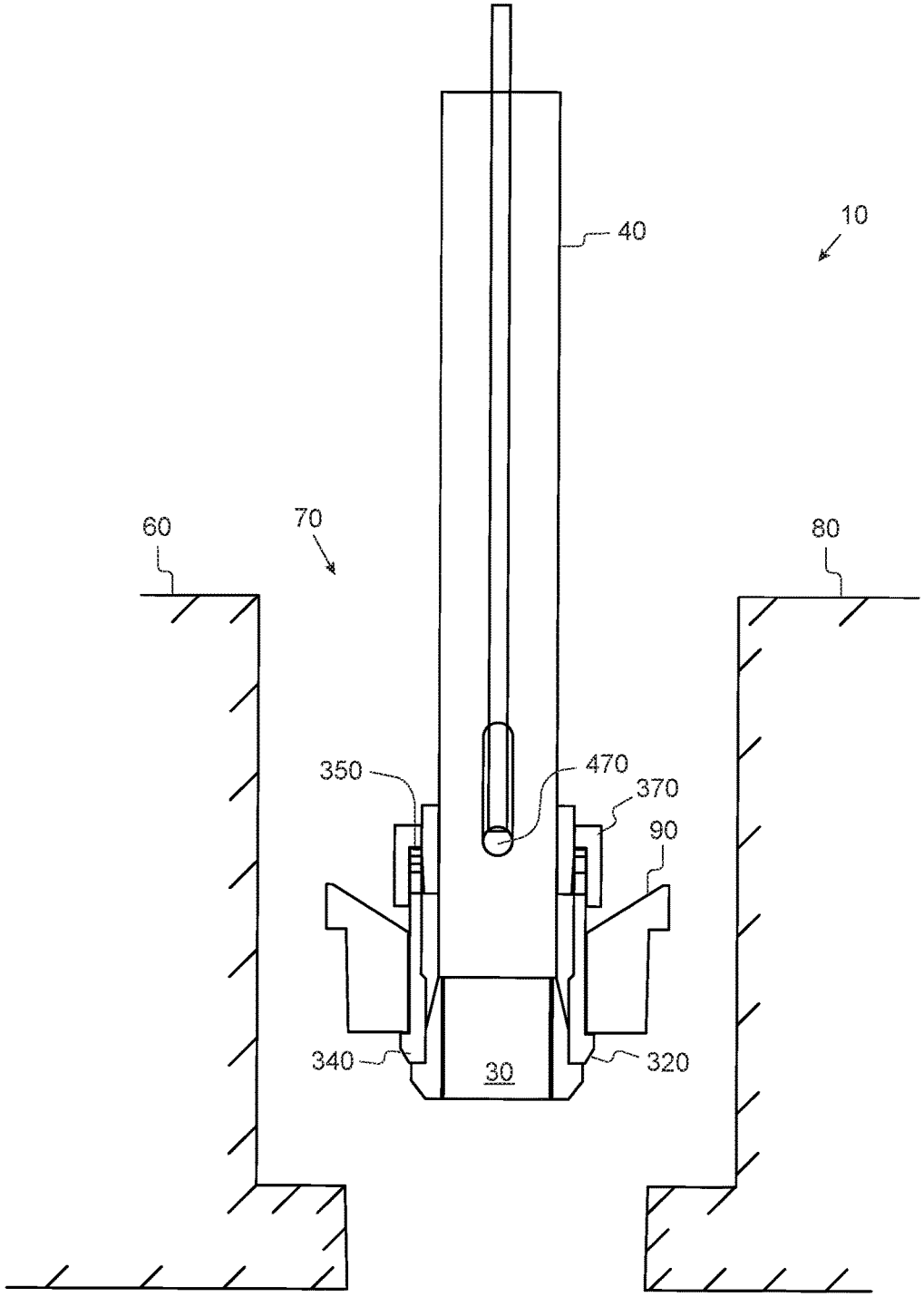

FIG. 17 generally depicts the lifting out of valve seat 90 in accordance with the current invention.

Figure 18:
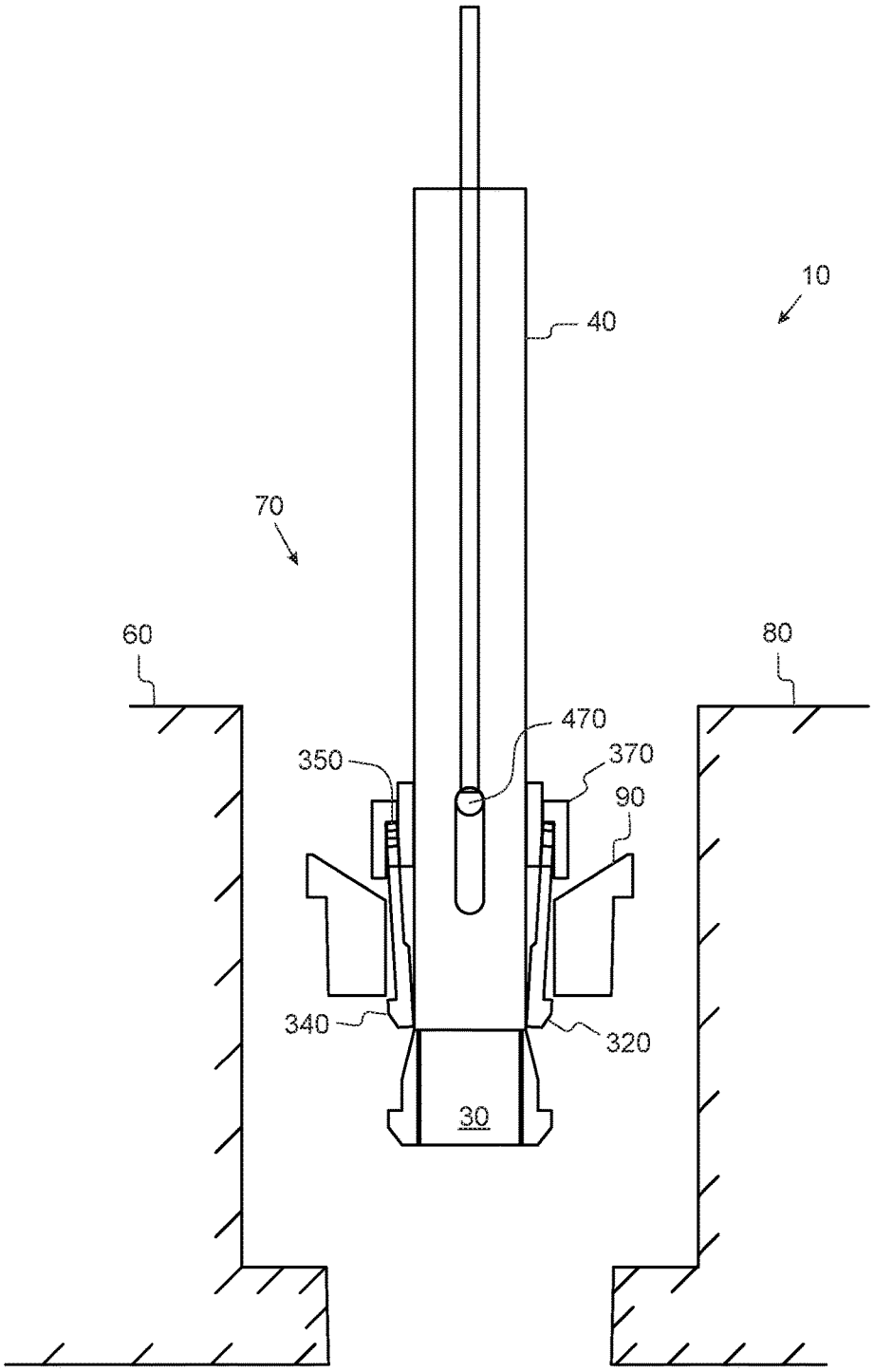

FIG. 18 generally depict engagement mechanism 410 changing catch assembly 320 from the second position 390 back to first position 380 wherein valve seat 90 has fallen off in accordance with the current invention.

Figure 19:
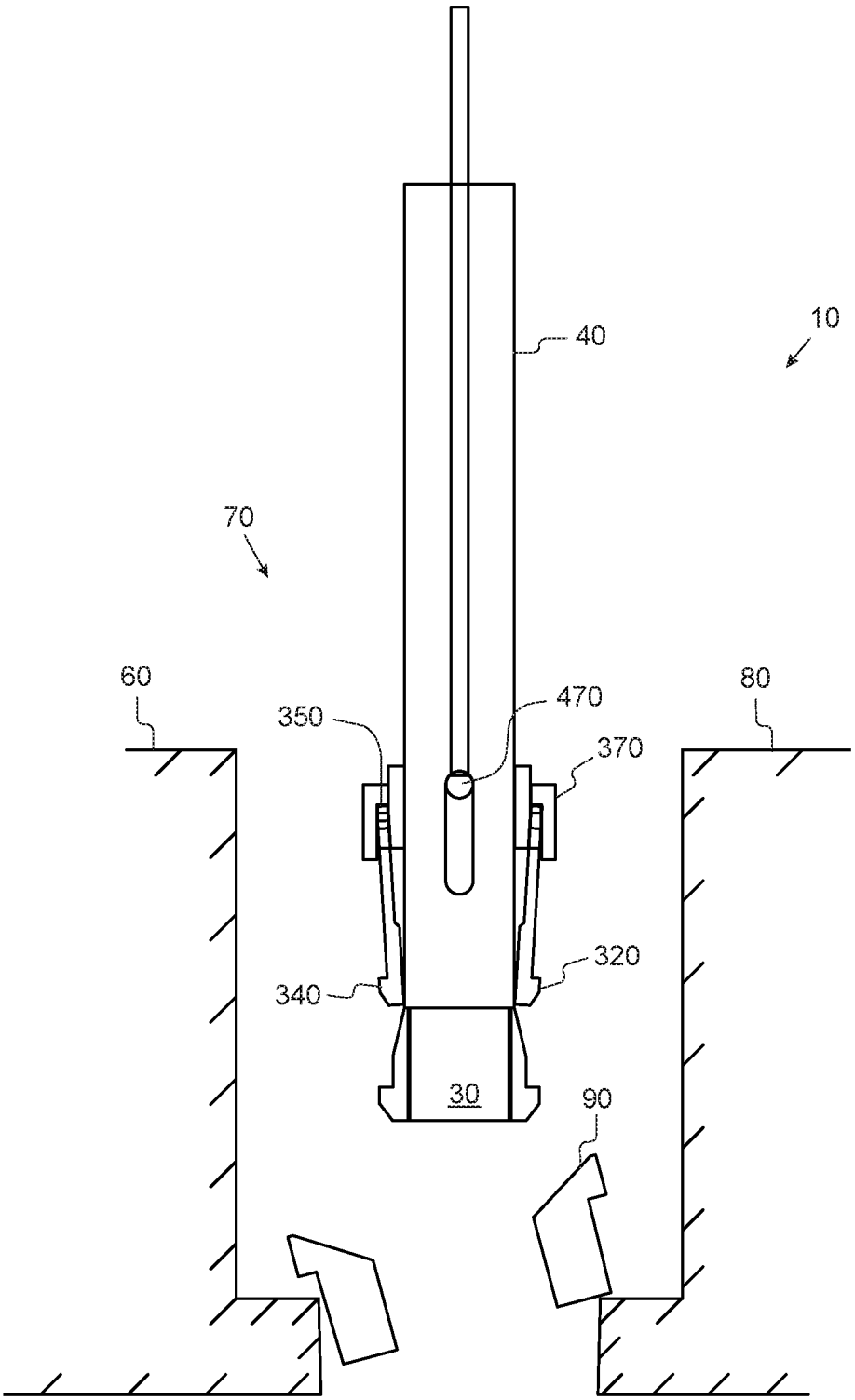

FIG. 19 generally depicts engagement mechanism 410 changing catch assembly 320 from second position 390 back to first position 380 wherein valve seat 90 is free to fall off in accordance with the current invention.

Figure 20:
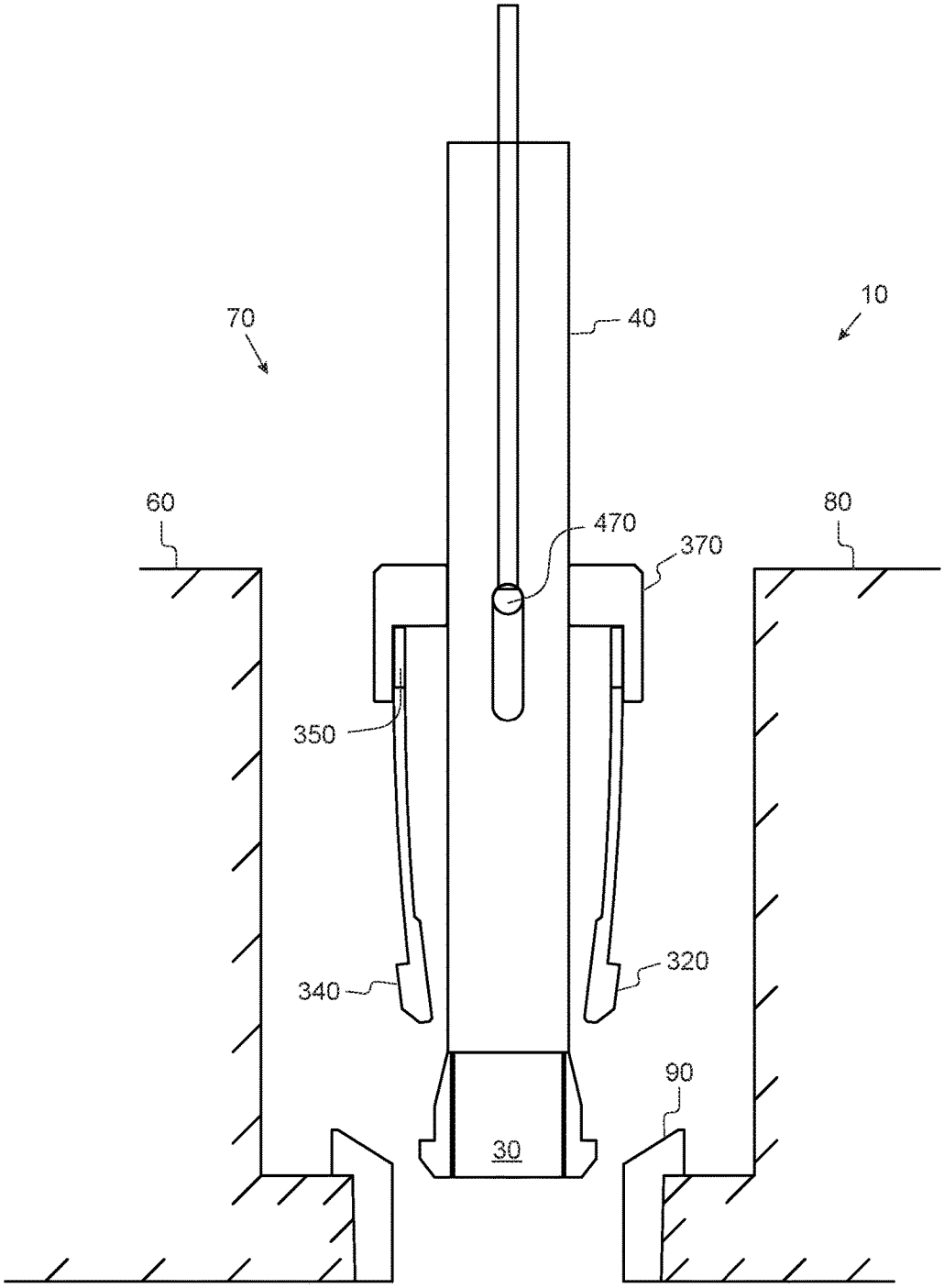

FIG. 20 generally depicts still another preferred embodiment wherein spring catch 20 is utilized with catch assembly 320 instead of J-shaped hooks 340 in accordance with the current invention.

Figure 21C:
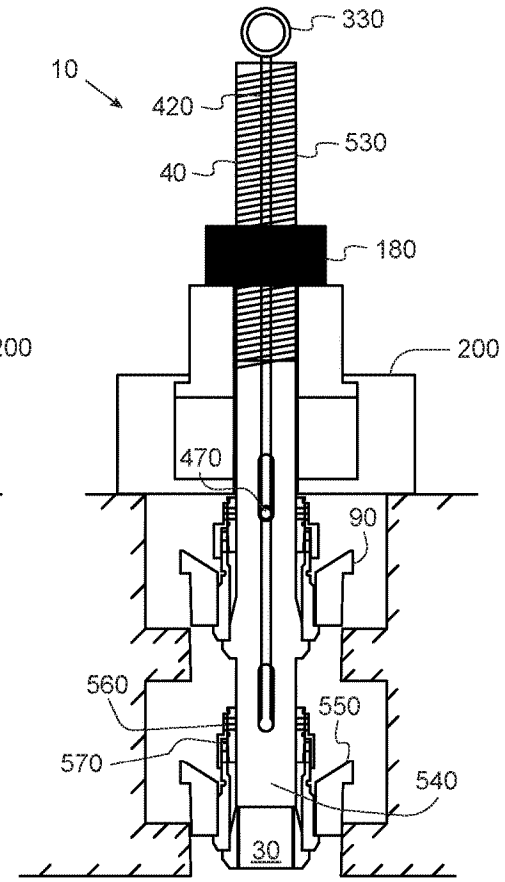
Figure 21B:
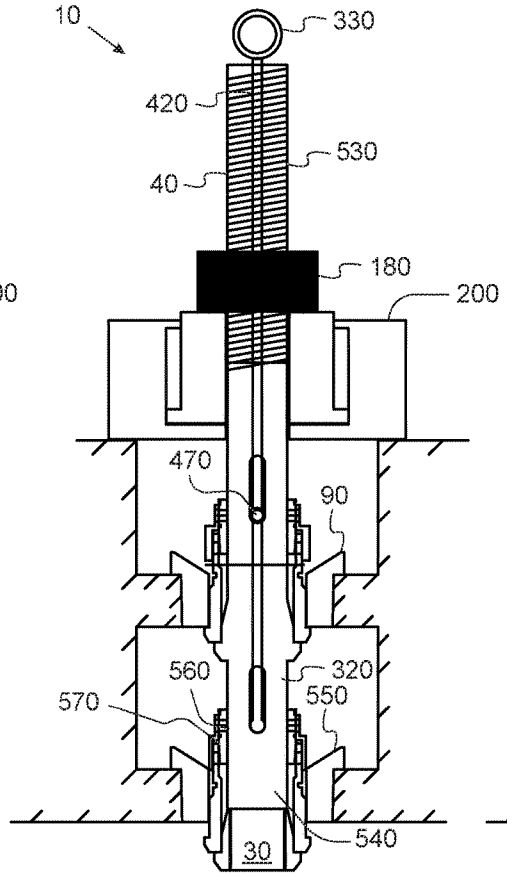
Figure 21A:
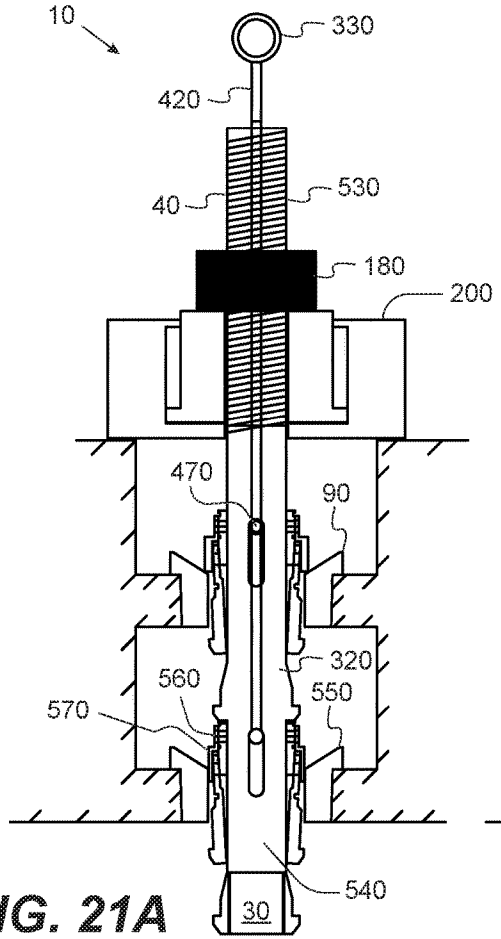

FIG. 21A generally depicts yet another preferred embodiment passing through one or more valve seats 90 where one or more valve seats 90 may need to be removed and having one or more catch assemblies in accordance with the current invention.

FIG. 21B generally depicts the preferred embodiment of FIG. 21A engaging one or more valve seats 90 and in accordance with the current invention.

FIG. 21C generally depicts the preferred embodiment of FIG. 21A removing one or more valve seats 90 and in accordance with the current invention.

DETAILED DESCRIPTION OF THE PREFERRED EMBODIMENTS

Referring to the illustrations, drawings, and pictures, reference character 10 generally designates a new and improved puller device, assembly, system and method of using same constructed in accordance with the present invention. Invention 10 is generally used in oil and gas well operations but may be utilized in other applications. The current invention should not be considered limited to just removing seat, valve seat, pump liners, and so forth.

Figure 1:
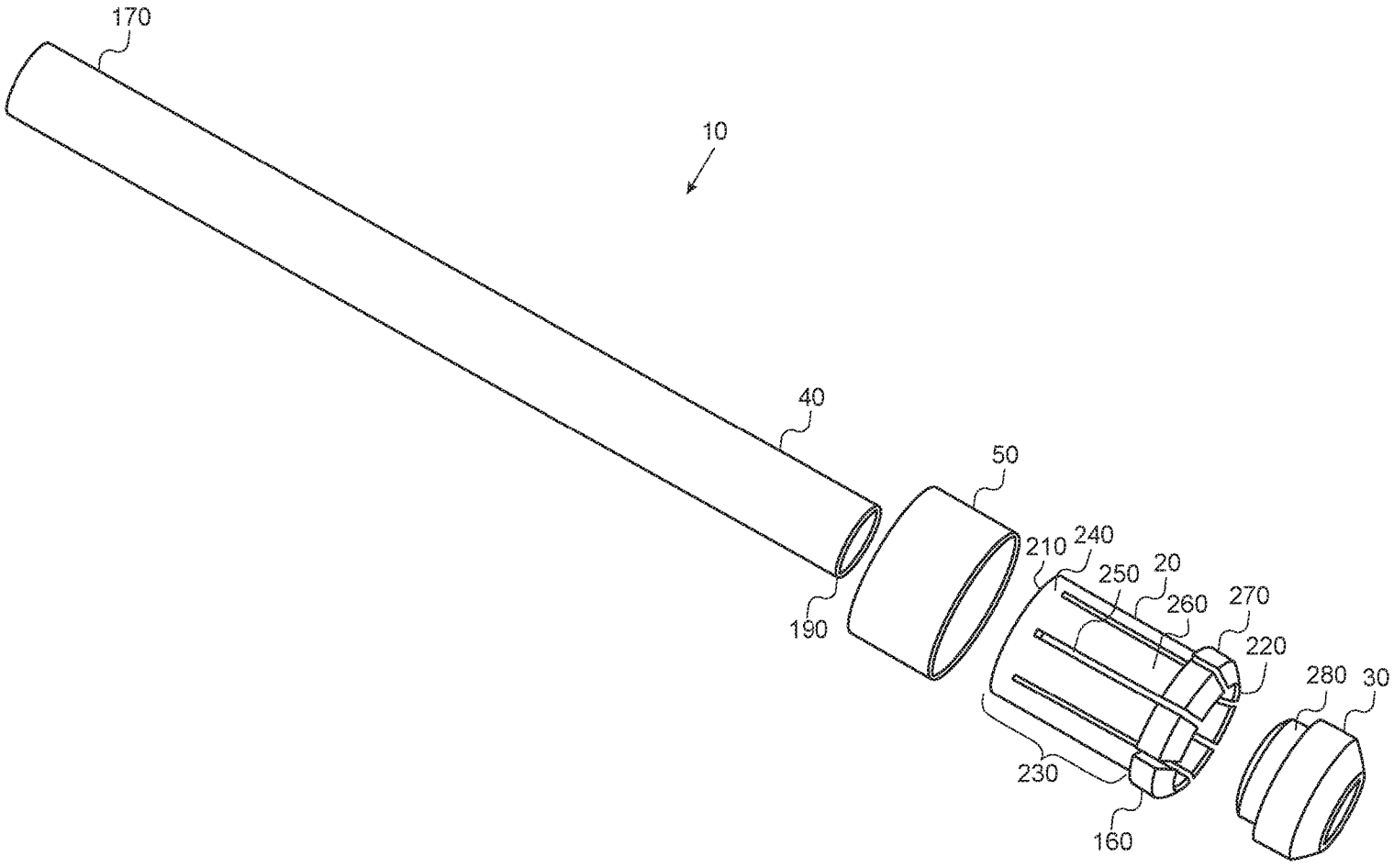

Now referring to the illustrations and more in particular to FIG. 1, invention 10 may include spring catch 20, bottom nose 30, puller shaft 40, and sleeve 50 generally positioned axially as depicted in the illustrations as will be discussed further below.

Figure 2:
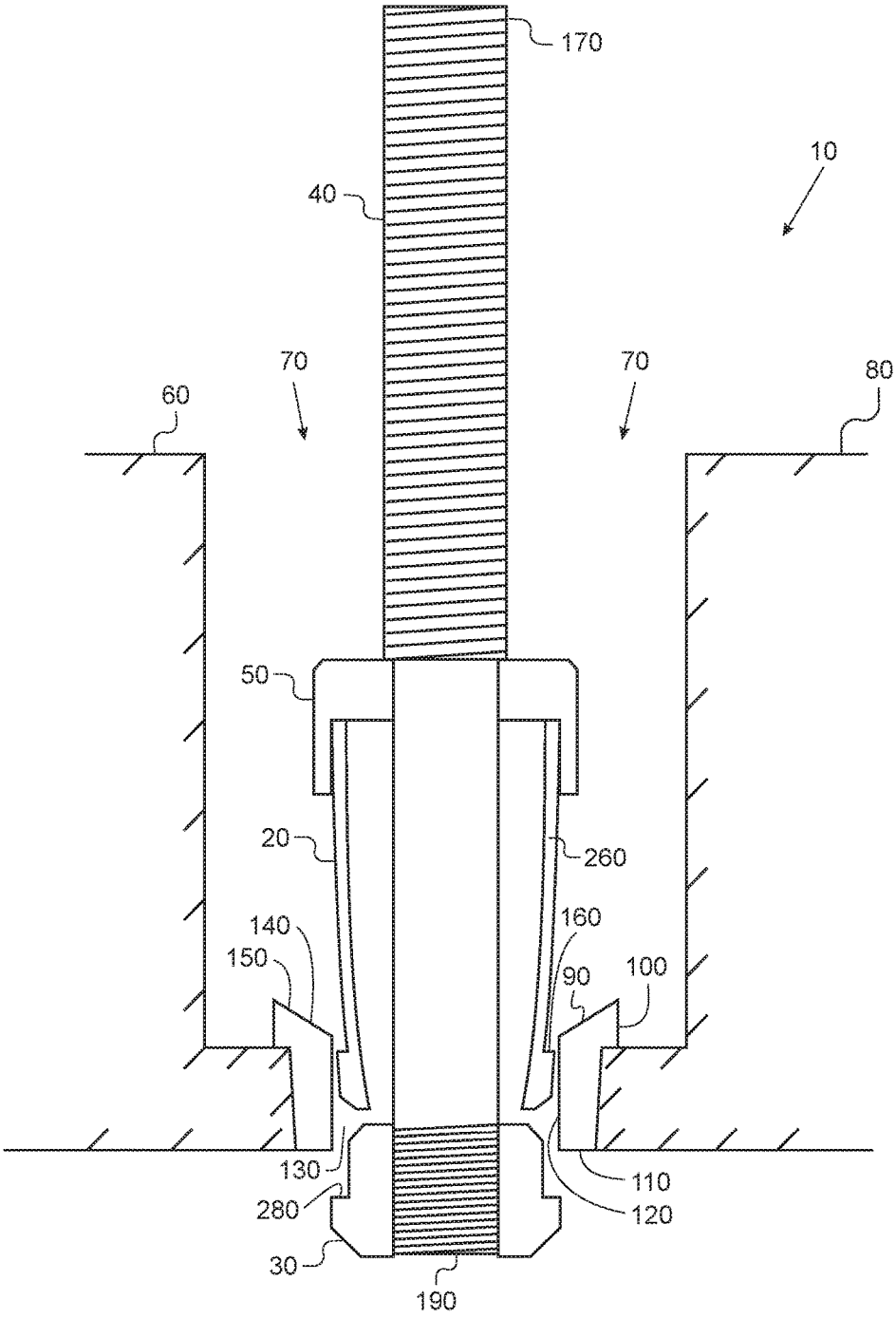
Figure 3:
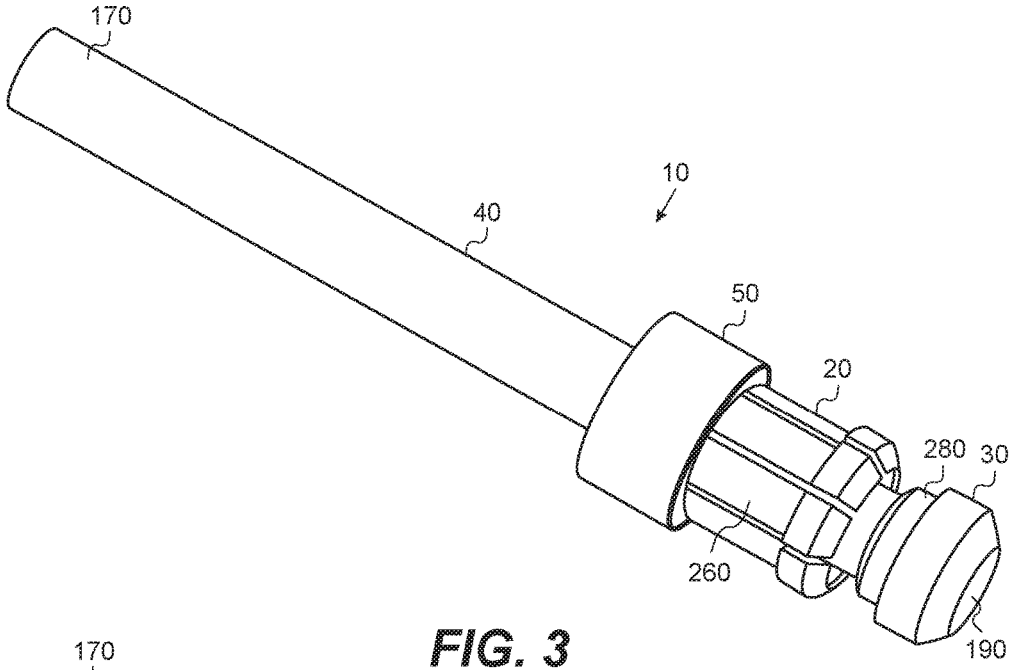
Figure 4:
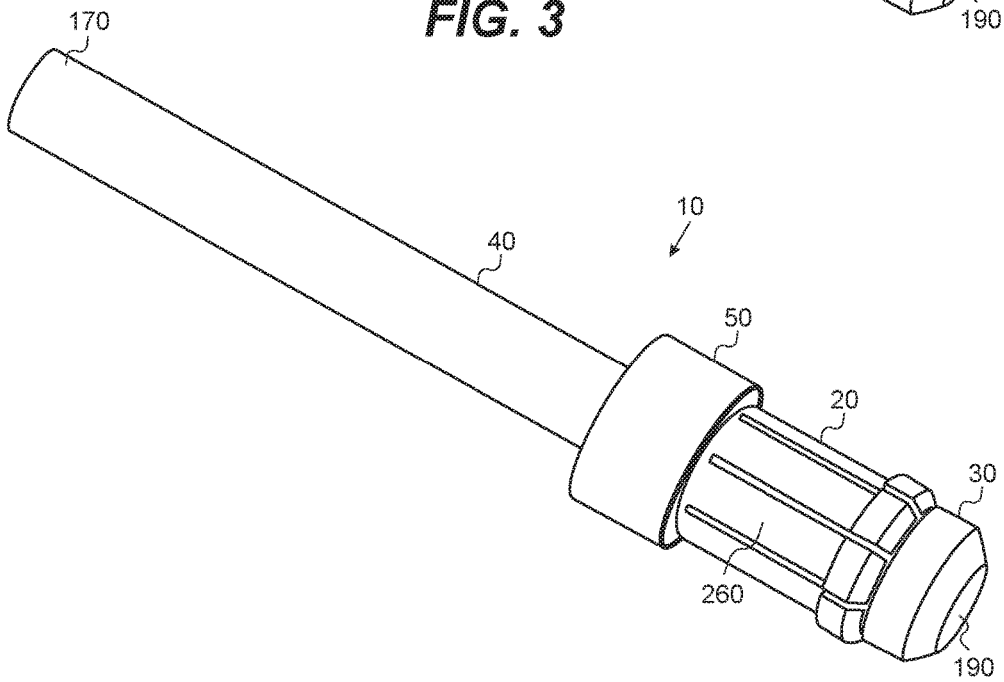
Figure 5D:
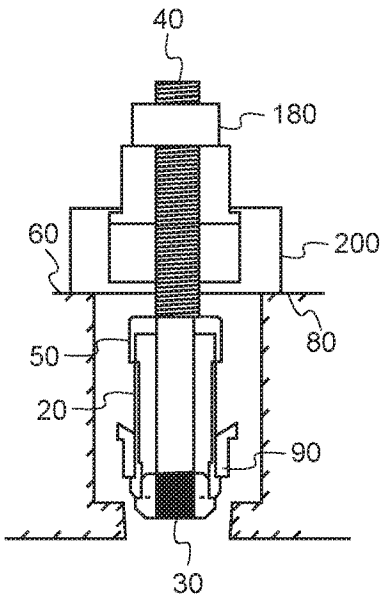
Figure 5C:
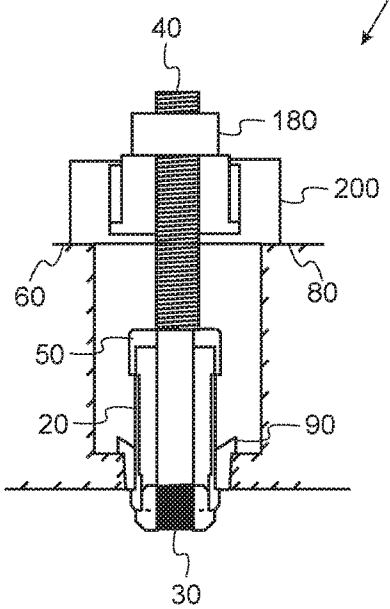
Figure 5B:
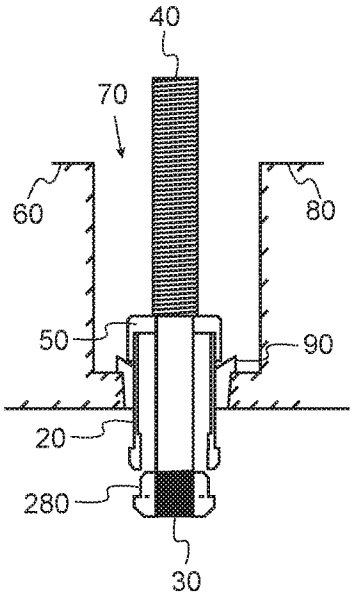
Figure 5A:
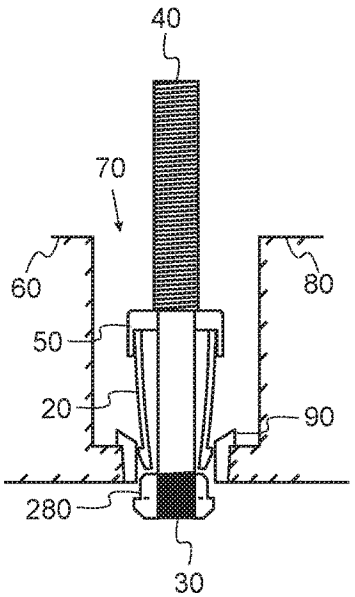
Figure 6A:
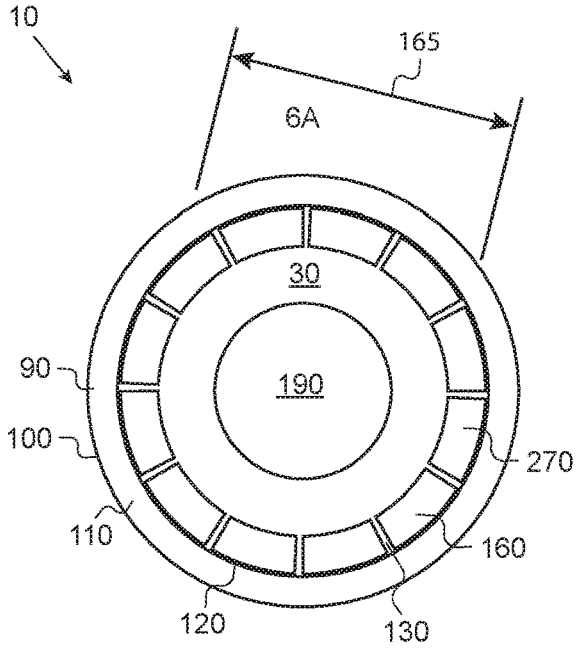
Figure 6B:
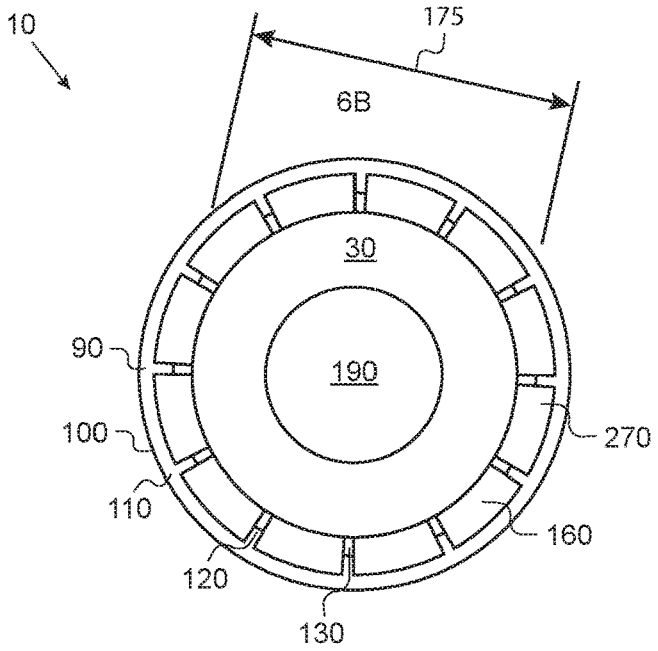
Figure 8:
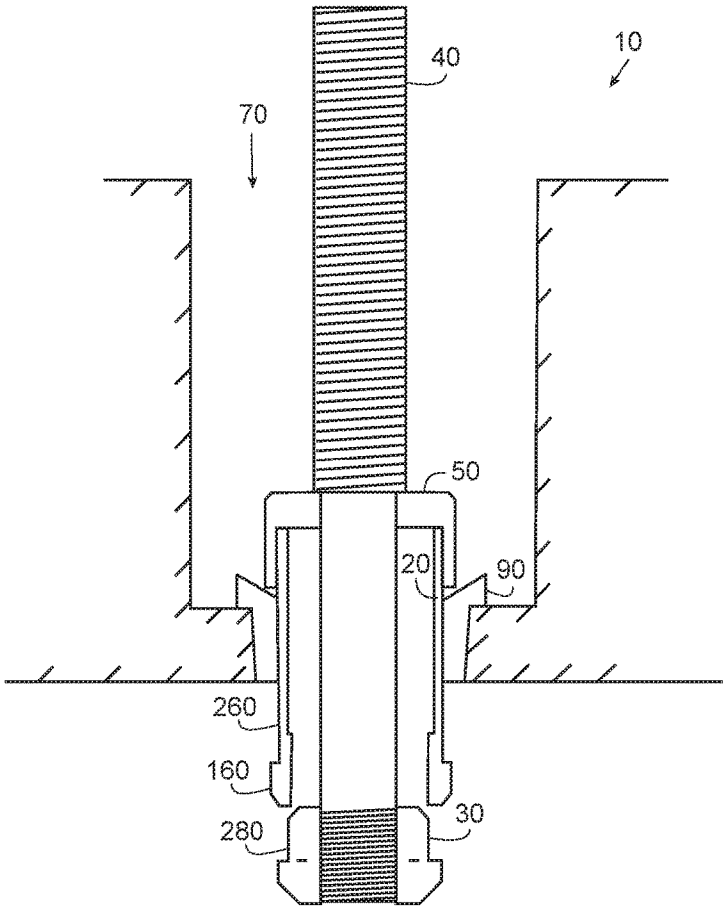
Figure 7:
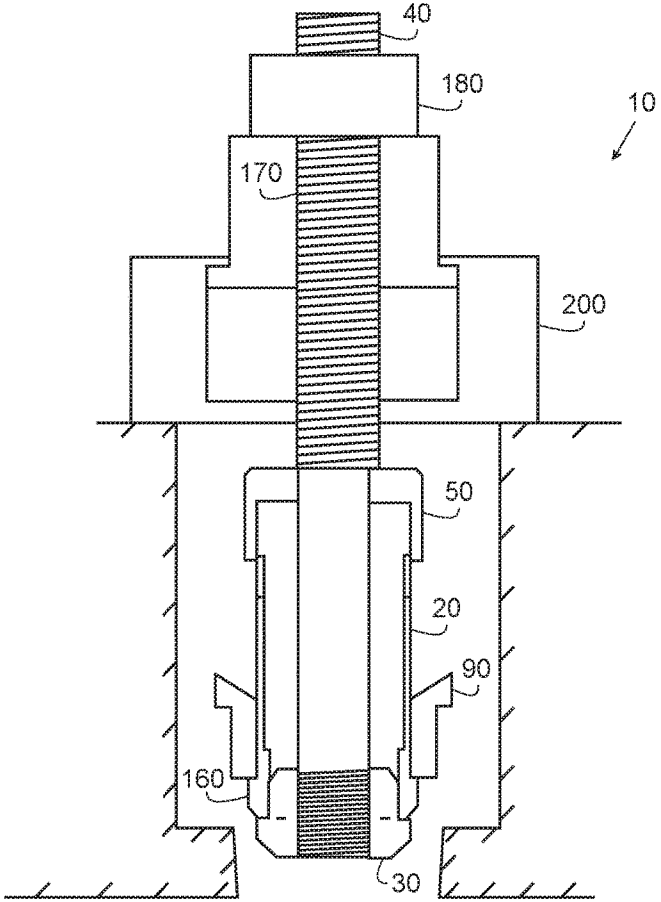
Figure 9:
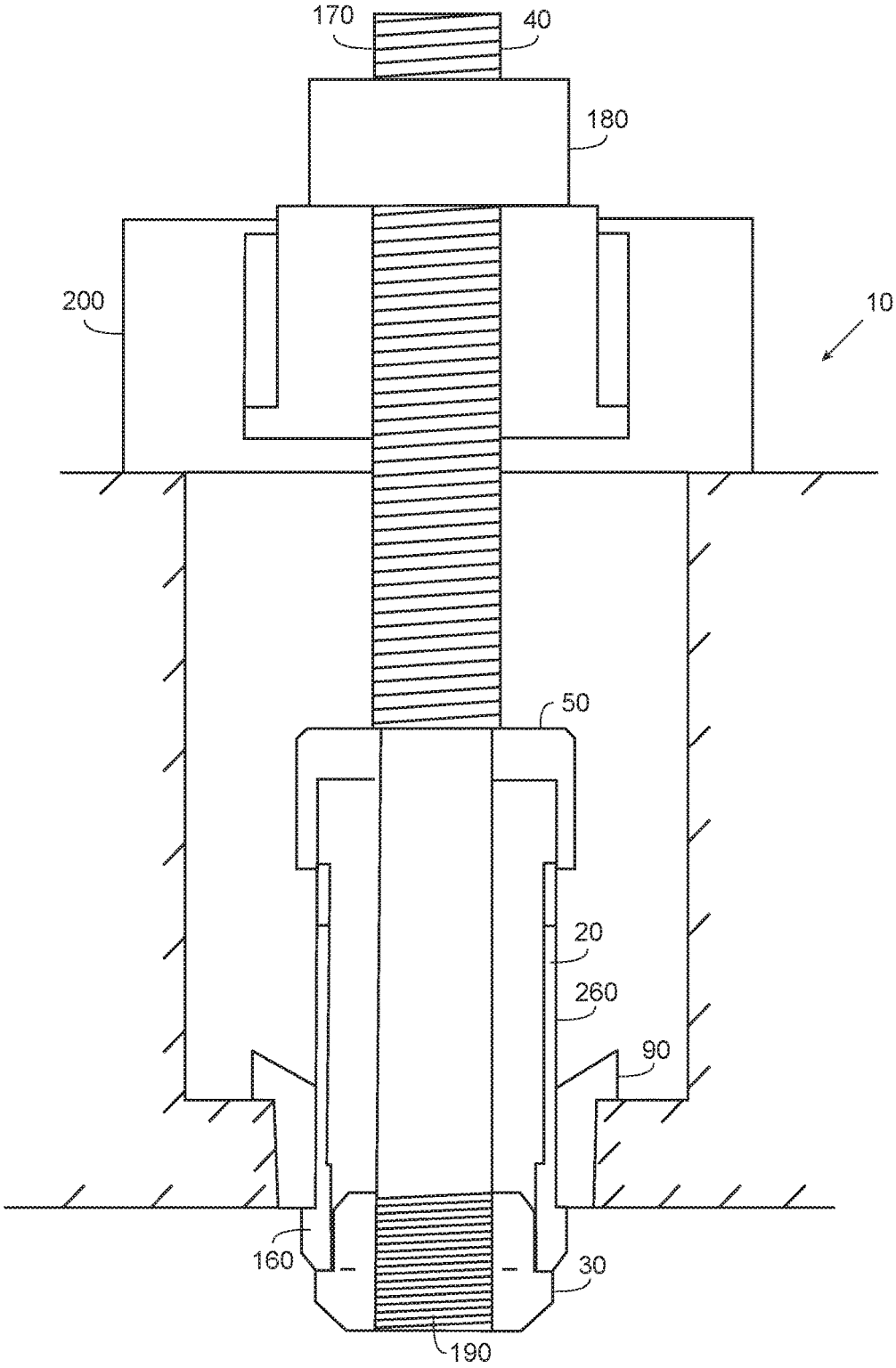
Figure 10:
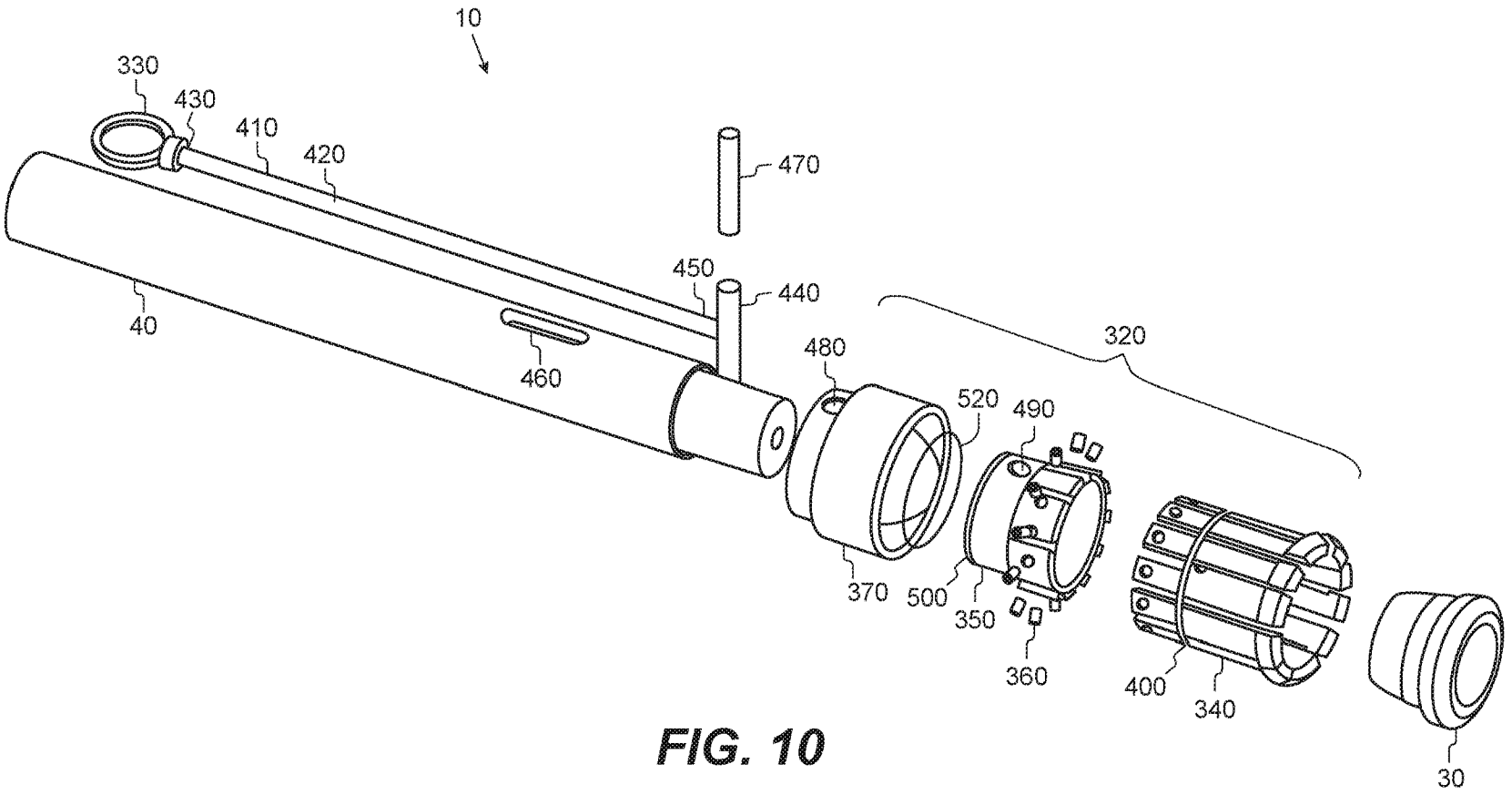
FIG. 10 is generally another preferred embodiment of the invention depicting an exploded perspective view in accordance with the current invention.
Figure 11:
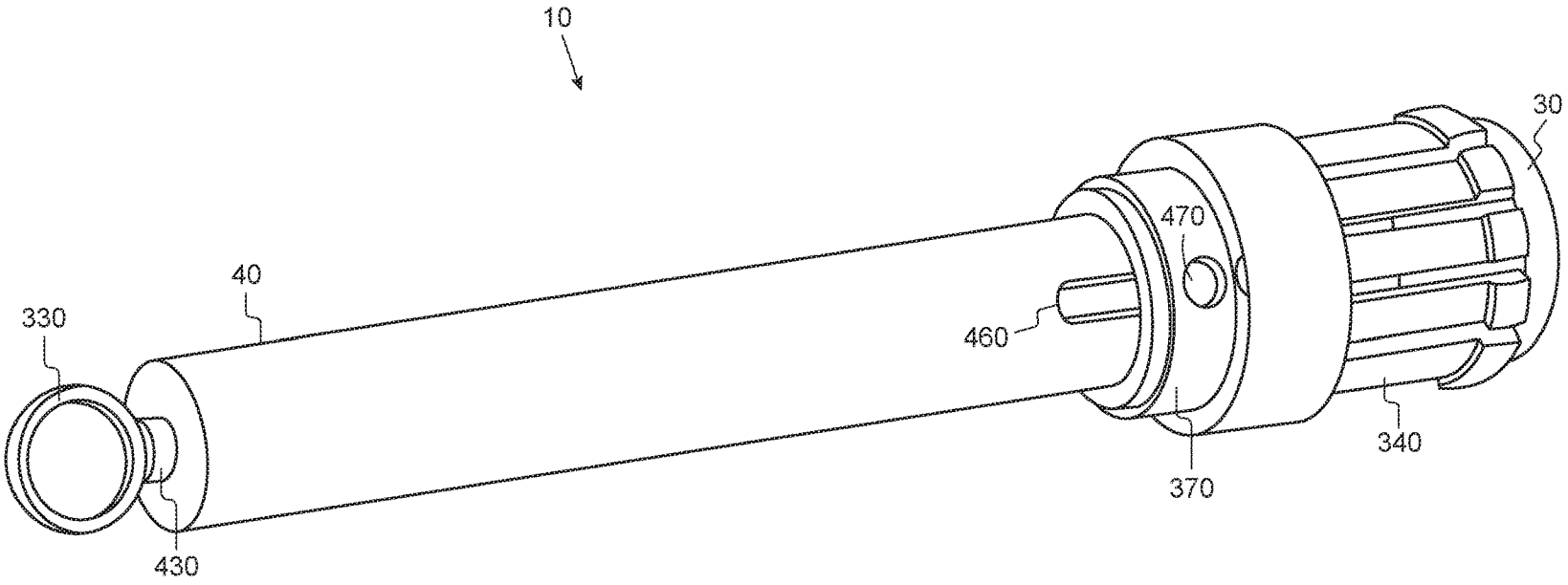
FIG. 11 is generally a preferred embodiment of the invention depicting an assembled perspective view of the embodiment in FIG. 10 in accordance with the current invention.

Again referring to the drawings in general and more specifically to FIG. 2, invention 10 may generally be utilized with pump assembly 60. A portion of the invention 10 is generally depicted being inserted into hole or opening 70 of pump or pump head 80 for engaging stuck valve seat 90. Valve seat 90 comprises outer diameter or ring 100 having lower rim or bottom face 110 and inner diameter or ring 120. The inner diameter 120 has an aperture 130. Valve seat 90 may also include a top face or portion 140 having an angled surface 150.

Spring catch 20 may be generally cylindrical and made from a metal alloy that allows for flexing and or bending, durable for the force required and also rigid enough to return to its original shape after flexing or bending. A preferred construction may be made from American Iron and Steel Institute, also known as AISI, 8620 alloy steel that is a hardenable chromium, molybdenum, nickel low alloy steel often used for carburizing to develop a case-hardened part.

Its chemical properties may be:

| | |
|---|---|
| Carbon | 0.18-0.23 |
| Chromium | 0.4-0.6 |
| Manganese | 0.7-0.9 |
| Molybdenum | 0.15-0.25 |
| Nickel | 0.4-0.7 |
| Phosphorus | 0.035 max |
| Silicon | 0.15-0.35 |
| Sulphur | 0.04 max |

Its physical properties may be:

| | |
|---|---|
| Density (lb/cu. in.) | 0.283 |
| Specific Gravity | 7.8 |
| Specific Heat (Btu/lb/° F. - [32-212° F.]) | 0.1 |
| Melting Point (° F.) | 2600 |
| Thermal Conductivity | 26 |
| Mean Coeff Thermal Expansion | 6.6 |
| Modulus of Elasticity Tension | 31 |

Spring catch 20 is generally formed of J-shaped hooks 160 that allow for flexing and or bending. A preferred embodiment is of a one piece construction having twelve (12) J-shaped hooks 160 although more or less J-shaped hooks 160 may be utilized. The spacing between the J-shaped hooks 160 generally allows for the circumference to be made smaller when the J-shaped hooks 160 are compressed such as but not limited to bending into smaller circumference 165. The spring quality of the design allows for the J-shaped hooks 160 to return to the original spacing when not compressed such as but not limited to going back to original circumference 175.

Puller shaft 40 may generally be threaded and utilized to hold spring catch 20 and sleeve 50. It may be rotated for the desired lifting and lowered from above by hydraulic means, mechanical means, and combinations thereof. Invention 10 contemplates utilization with hydraulic jack 200; puller shaft 40 may be made of steel known in the industry and have threading known in the industry. Puller shaft 40 may generally comprise a top or top portion 170 that may attach to a nut 180 for holding puller shaft 40 in a relatively fixed position in opening 70 of pump head 80 while allowing the puller shaft 40 to move up and down as desired. The movement may be accomplished through hydraulic, mechanical and combinations thereof as known in the art. Bottom or bottom portion 190 of puller shaft 40 may generally be utilized to removably hold bottom nose 30.

Bottom nose 30 may be made from steel and or other materials known in the art. Bottom nose 30 may generally be removably threaded onto and axially aligned with puller shaft 40 bottom portion 190. It is understood that numerous types of removable connections to puller shaft 40 are contemplated.

Sleeve 50 may also be constructed from steel and other materials known in the art. It is contemplated that sleeve 50 is generally fixed axially on puller shaft 40 and generally holds spring catch 20 and allows spring catch 20 to move up and down, relative to puller shaft 40, while being trapped at the top of spring catch 20 inside sleeve 50. Generally, this configuration provides a "floating" spring catch 20 inside sleeve 50. It is also contemplated that invention 10 may not utilize sleeve 50, sleeve 50 may be incorporated into spring catch 20, sleeve 50 may be generally non-movably fixed to spring catch 20, combinations thereof and so forth. Sleeve 50 may generally look like a cup and or cap fixed and or removably fixed on puller shaft 40 with threads, welds, and so forth.

Now again referring to the illustrations and more in particular to FIGS. 3-9, generally, the puller shaft 40 is inserted in through the valve seat 90 from the top of the pump head 80 by inserting the puller shaft 40 bottom nose 30 down hole or opening 70 until bottom nose 30 passes valve seat 90 and sleeve 50 contacts top of valve seat 90 bringing puller shaft 40 essentially to a stop. Sleeve 50 may also generally function as a general guide for passing spring catch 20 through the pump assembly 60 as well as an indicator when the puller shaft 40 has descended far enough into the pump assembly 60 to engage valve seat 90.

It is then contemplated that hollow shaft hydraulic jack 200 is put onto the puller shaft 40 and secured by nut 180. At this point, the valve seat 90 is pulled upward by the hydraulic jack 200. It is contemplated that invention 10 will allow for a generally vertical removal of valve seat 90 without the need for a rotational force as the prior art devices. It is also contemplated that puller shaft 40 may not be threaded. It is still further contemplated that top or top portion 170 of puller shaft 40 may be formed and or adapted to attach and or communicate with hydraulic jack 200 as known in the prior art.

The improved design of invention 10 generally pushes steel spring catch 20 through valve seat 90 and then springs back once passing the bottom face 110 of valve seat 90. J-shaped hooks 160 are essentially forced into bending into smaller circumference 165 as the downward force on spring catch 20 contacts with the angled surface 150 of valve seat 90. After the J-shaped hooks 160 clear the bottom face 110 of valve seat 90, they are allowed to spring back and or unbend to the original circumference 175 thus allowing the J-shaped hooks 160 to engage the lower rim 110 of valve seat 90 for pulling upward and out.

The bottom nose 30 of invention 10 is pulled up inside of the spring catch 20, causing the spring catch 20 to be held rigid and not allowing it to close. Thus creating a near solid ring of steel at bottom 190 of the puller shaft 40 just below bottom face 110 of valve seat 90. The yield strength of this ring may be greater than that of the hydraulic jack 200 currently being used to pull valve seats 90.

Once the seat is removed from the pump, the bottom nose 30 of the invention 10 may then be removed by simply loosening it from the puller shaft 40 by hand. Steel spring catch 20 is then slid off of puller shaft 40, and then valve seat 90 may be slid off. Steel spring catch 20 may then be placed back on puller shaft 40 and bottom nose 30 may then be threaded back until it stops turning. Current invention 10 generally requires no tools to be assembled or disassembled.

Spring catch 20 may generally be a one piece hollow cylindrical construction having top 210, bottom 220, length 230, and wall 240. Top 210 is generally a solid ring whereas wall 240 has split(s) and or slit(s) 250 for forming protrusion(s) and or segment(s) 260 along wall 240. It is contemplated that spring catch 20 may be hollow and have an aperture and or opening through length 230 with open ended top 210 and bottom 220. It is also understood that top 210 may not be open and have a solid portion not depicted.

J-shaped hook or hooks 160 are generally formed from segments 260 wherein distal end(s) 270 has a J-shaped end(s). It is also understood that distal end(s) 270 may look more like an L-shape and the term J-shaped should not be considered to limit the invention to such. Generally, top 210 is formed not to flex and or compress but remain essentially rigid. Slits(s) 250 allow segment(s) 260 to change the circumference of bottom 220 from un-flexed and or non-compressed spring catch 20 of original circumference 175 to a flexed and or compressed smaller circumference 165. Generally, compression and or flexion occur when segment(s) 260 bend inward. It is contemplated top 210 does not bend nor bottom 220. Distal end(s) 270 are contemplated to also stay generally rigid.

It is further contemplated bottom nose 30 may include recessed lip portion 280 wherein after engagement of valve seat 90 by spring catch 20, distal end(s) 270 of J-shaped hook or hooks 160 are generally trapped against bottom nose 30 after spring catch 20 slides into position for extraction. It is contemplated that this may generally add structural support to bottom 220 of spring catch 20 as well as keep spring catch 20 in original circumference 175 during the removal process.

Other Preferred Embodiments

Referring to the illustrations and more in particular to FIGS. 10, 11, 12A and 12B, invention 10 further contemplates providing an embodiment wherein spring catch 20 is not a spring per se. It is contemplated to provide catch assembly 320, which may engage valve seat 90 with bottom nose 30 in the same general fashion as spring catch 20, but wherein spring catch 20 generally floats in sleeve 50 that generally stays fixed to puller shaft 40 and moves relative to the pushing down force or upwards force of the puller shaft 40, catch assembly 320 may be activated by hand with a release ring 330 and generally independent of puller shaft 40 movement as discussed further below.

Catch assembly 320 may comprise series of individual J-shaped hooks 340 that are generally connected to inner housing 350 with attachments 360 that may be but are not limited to set screws, rivets, pins and so forth. Inner housing 350 is generally positioned in outer and or sleeve housing 370.

Catch assembly 320 generally provides for two movements during operation. J-shaped hooks 340 are generally adapted for first position 380 wherein the J-shaped hooks 340 are collapsed in making a smaller circumference and second position 390 wherein the J-shaped hooks 340 are more spread out for engaging valve seat 90. In the prior embodiment above, spring catch 20 generally assumes three movements with the first spread out, then collapsed for passing through valve seat 90, then spread out again after engaging valve seat 90.

Catch assembly 320 may include but is not limited to an O-ring 400, which may be used as a spring to collapse J-shaped hooks 340 as passing through seat valve 90. It is also contemplated to use a band spring, plastic elastomer and so forth. As catch assembly 320 is moved down puller shaft 40, O-ring 400 is generally stretched as the J-shaped hooks 340 engage bottom nose 30 after passing valve seat 90. This embodiment of invention 10 is now positioned to engage valve seat 90 for removal.

Engagement mechanism 410 may include a connecting rod 420 through puller shaft 40 with release ring 330 at top 430 of rod 420 and a T connector 440 at bottom or end 450 of rod 420. T connector 440 may be removably attached and or non-removably attached to rod 420 end 450. Invention 10 contemplates but is not limited to attachment by mating threads, bayonet, and so forth.

Puller shaft 40 may include a slot and or aperture 460 for generally securing catch assembly 320 in a movable fashion along puller shaft 40 for engaging and disengagement with valve seat 90. T connector 440 may utilize pin 470, which may cooperate with aperture 480 of sleeve housing 370 and aperture 490 of inner housing 350.

Inner housing 350 may connect with snap ring 500 to sleeve housing 370, which may include a groove 510. Friction ring 520 may be but is not limited to an O-ring and generally utilized to provide friction between inner housing 350 and sleeve housing 370.

FIG. 12A is generally a depiction of a preferred embodiment of the invention generally showing a cutaway side view as utilized in a pump and generally depicting catch assembly 320 preparing to passing through valve seat 90. Catch assembly 320 is in the first position 380 wherein J-shaped hooks 340 are generally collapsed in accordance with the current invention.

FIG. 12B is generally a depiction of a preferred embodiment of the invention generally showing a cutaway side view as utilized in a pump and generally depicting catch assembly 320 preparing to engage valve seat 90 for removal. Catch assembly 320 is in the second position 390 wherein J-shaped hooks 340 are generally spread out and engaging bottom nose 30. FIG. 13 is generally the depiction in FIG. 12B of invention 10 demonstrating that catch assembly 320 may not pass through valve seat 90 when in the second position 390.

FIG. 14 is generally a preferred embodiment of the invention depicting catch assembly 320 in the first position 380 preparing to pass through valve seat 90. FIG. 15 is generally depicting catch assembly 320 in the first position 380 preparing to pass through valve seat 90 wherein sleeve housing 370 has contacted valve seat 90, which may indicate it is time to utilize engagement mechanism 410 changing catch assembly 320 from the first position 380 to second position 390.

FIG. 16 is generally depicting catch assembly 320 in second position 390 engaging valve seat 90 for removal. FIG. 17 generally depicts the lifting out of valve seat 90. FIG. 18 and FIG. 19 generally depicts engagement mechanism 410 changing catch assembly 320 from the second position 390 back to first position 380 wherein valve seat 90 is free to fall off. It may be desirable to allow valve seat 90 to be removed from an access hole and not lifted up along with puller shaft 40.

Referring to the illustrations and more in particular to FIG. 20, in still another preferred embodiment, invention 10 further contemplates providing an embodiment wherein spring catch 20 is utilized with catch assembly 320 instead of J-shaped hooks 340. This may provide for a spring action that may be utilized independent of puller shaft 40 travel direction as generally discussed in the above embodiment.

Once again, referring to the illustrations in general and more in particular to FIGS. 21A, 21B, and 21C, invention 10 also contemplates utilization for situations where one or more valve seats 90 may need to be removed. Invention 10 may provide setting a puller over the hole once to remove both seats thereby further decreasing repair time.

In a preferred embodiment, double head puller 530 may have a second and or lower catch assembly 540, which may eliminate the need for repetition and to generally eliminate the need to run nut 180 up and down on shaft 40 when removing more than one seat 90. It is contemplated to arrange catch assembly 320 and second and or lower catch assembly 540 on puller shaft 40 slightly father apart in distance than first valve seat 90 and second or bottom valve seat 550. It is contemplated the distance may be half an inch although greater and shorter distance may be contemplated.

Lower catch assembly 540 may generally have a smaller inner housing 560 and sleeve housing 570 wherein lower catch assembly 540 may pass through valve seat 90. It is contemplated that inner housing 560 and sleeve housing 570 may be of a diameter to set the correct height for engaging valve seat 90 as generally discussed above.

Invention 10 contemplates the pulling action with double head puller 530 may be generally the same as the previous discussed embodiments although when jack 200 starts, the top valve seat 90 is pulled loose, and then nut 180 on top of jack 200 is run back down to compress jack 200, then jack 200 is actuated again pulling the bottom valve seat 550. Release may generally be as discussed above whereby pulling ring 330 generally collapses both lower catch assembly 540 and catch assembly 320 for retrieving up through valve seat 90 and valve seat 550.

Invention 10 therefor contemplates a valve seat puller for removing a valve seat from a pump wherein said valve seat has an outer diameter, a bottom face, an inner diameter, an aperture defined by said inner diameter, and a top face, said valve seat puller comprising: a puller shaft tube having a top with an aperture, a bottom, and a length defined between said top and said bottom; a bottom nose axially aligned with said puller shaft and attached to said bottom of said puller shaft, having a recessed lip portion adapted to trap J-shaped hooks against and on said recessed lip portion while said J-shaped hooks engage said bottom face of said valve seat; a catch axially positioned on said length of said puller shaft length comprising: a hollow cylinder having a top, a bottom, a wall with a length, a plurality of slits on said length of said wall starting below said top thereby forming a plurality of segments protruding down from said top wherein said plurality of segments each have a distal end forming said bottom of said catch and wherein each said distal end is said J-shaped hook and wherein said plurality of segments are adapted to pivot outward when contacting said bottom nose of said valve seat, pass through said inner diameter of said valve seat and said J-shaped hooks can engage said bottom face of said valve seat for lifting said valve seat from said pump; a sleeve axially positioned on said puller shaft said length and adapted to hold said top of said catch wherein said sleeve is adapted to slide up and down said length of said puller shaft; a flexible O-ring adapted to hold said plurality of segments inward against said shaft and allow said plurality of segments to spread outward when said plurality of segments engage said bottom nose; and a connector rod having a top, a length, a bottom wherein said connector rod is disposed length wise inside said puller shaft and said top sticks out said aperture of said top of said puller shaft tube for pulling and pushing said connector rod upward through said length of said puller shaft and wherein said bottom of said connector rod is attached to said sleeve and said hollow cylinder.

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

What is claimed is:

1. A valve seat puller for removing a valve seat from a pump wherein said valve seat has an outer diameter, a bottom face, an inner diameter, an aperture defined by said inner diameter, and a top face, said valve seat puller comprising:

a puller shaft tube having a top with an aperture, a bottom, and a length defined between said top and said bottom;

a bottom nose axially aligned with said puller shaft tube and attached to said bottom of said puller shaft tube, having a recessed lip portion comprising a flat surface perpendicular to said length of said puller shaft tube and having an outer diameter, a vertical surface parallel to said length of said puller shaft tube and having a smaller outer diameter than said outer diameter of said flat surface, adapted to trap J-shaped hooks against said vertical surface of said lip portion and on said flat surface of said recessed lip portion while said J-shaped hooks engage said bottom face of said valve seat;

a catch axially positioned on said length of said puller shaft tube length comprising:

a hollow cylinder having a top, a bottom, a wall with a length, a plurality of slits on said length of said wall starting below said top thereby forming a plurality of segments protruding down from said top wherein said plurality of segments each have a distal end forming a bottom of said catch and wherein each said distal end is said J-shaped hook and wherein said plurality of segments are adapted to pivot outward when contacting said bottom nose of said valve seat, pass through said inner diameter of said valve seat and said J-shaped hooks can engage said bottom face of said valve seat for lifting said valve seat from said pump;

a sleeve axially positioned on said length of said puller shaft tube said length and adapted to hold a top of said catch wherein said sleeve is adapted to slide up and down said length of said puller shaft tube;

a flexible O-ring adapted to hold said plurality of segments inward against said shaft and allow said plurality of segments to spread outward when said plurality of segments engage said bottom nose; and a connector rod having a top, a length, a bottom wherein said connector rod is disposed length wise inside said puller shaft tube and said top sticks out said aperture of said top of said puller shaft tube for pulling and pushing said connector rod upward through said length of said puller shaft tube and wherein said bottom of said connector rod is attached to said sleeve and said hollow cylinder.

* * * * *